United States Patent [19]

Vanderslice

[11] Patent Number: 4,673,599

[45] Date of Patent: Jun. 16, 1987

[54] SYNTHETIC FUR GARLAND AND METHOD OF MAKING SAME

[76] Inventor: David Vanderslice, 40 Oak Forest Dr., Sicklerville, N.J. 08081

[21] Appl. No.: 822,283

[22] Filed: Jan. 24, 1986

[51] Int. Cl.[4] ..... A41G 1/04

[52] U.S. Cl. ..... 428/10; 156/61; 156/203; 428/11; 428/15; 428/36; 428/89

[58] Field of Search ..... 428/10, 82, 7, 36, 11, 428/100, 15, 89; 139/387 R; 2/65; 57/203; 156/61, 203

[56] References Cited

U.S. PATENT DOCUMENTS

| | | | |
|---|---|---|---|
| Re. 13,393 | 4/1912 | DeLaski et al. | 139/387 R |
| 41,145 | 1/1864 | Gay | 2/65 |
| 70,163 | 10/1867 | Canter | 57/203 |
| D. 273,341 | 4/1984 | Rol | D2/344 |
| 1,119,120 | 12/1914 | Salzberger | 57/203 |
| 1,482,537 | 2/1924 | Alter et al. | 428/10 |
| 1,894,596 | 1/1933 | Moore | 66/9 B |
| 2,424,740 | 7/1947 | Chamberlain et al. | 2/258 |
| 2,953,002 | 9/1960 | Hill | 66/9 B |
| 2,990,640 | 7/1961 | Burnbaum | 428/11 X |
| 3,010,297 | 11/1961 | Hill | 66/9 B |
| 3,035,330 | 5/1962 | Cole | 428/7 X |
| 3,299,672 | 1/1967 | Schmidt | 66/9 R |
| 3,413,823 | 12/1968 | Beucus et al. | 66/9 B |
| 3,590,604 | 8/1971 | Beucus | 66/191 |
| 3,597,292 | 8/1971 | Takeda | 156/203 |
| 4,144,365 | 3/1979 | Scudder et al. | 428/10 |
| 4,164,058 | 8/1979 | Barna | 428/10 X |
| 4,254,181 | 3/1981 | Bromley et al. | 428/542.2 X |
| 4,271,329 | 6/1981 | Perelmuter | 428/36 X |
| 4,366,199 | 12/1982 | Grosjean | 428/82 X |

FOREIGN PATENT DOCUMENTS

| | | | |
|---|---|---|---|
| 1239252 | 4/1967 | Fed. Rep. of Germany | 2/65 |
| 1143007 | 4/1957 | France | 2/65 |
| 2113608 | 8/1983 | United Kingdom | 428/36 |

OTHER PUBLICATIONS

Offer for Sale by Rennoc. Corp. as described on the attached supplement.

*Primary Examiner*—Henry F. Epstein
*Attorney, Agent, or Firm*—Thomas A. Lennox

[57] ABSTRACT

Fur garland is prepared by cutting strips crosswise to the length of pelted knitted pile fabric, applying spray contact adhesive to the lengthwise edges of the plush pile, pulling on the strip lengthwise causing the knitted body to curl into a tubular shape adhesively attaching the edges together forming a plush garland, attaching tubular force fit interlocks on both ends of the garland allowing the garland to be connected in a continuous length.

23 Claims, 13 Drawing Figures

SYNTHETIC FUR GARLAND AND METHOD OF MAKING SAME

BACKGROUND OF THE INVENTION

This invention involves synthetic fur garland and method for making same.

Garland is used extensively for decorations on special occasions and has been in particular favor at Christmas time becoming a standard decoration on Christmas trees. Although natural types of garland using popcorn and evergreen is used, the most common commercially prepared garland is constructed of either plastic or foil threads attached to string providing a feathery appearance that is easily draped over the areas to be festooned. Nothing in the specification or the claims should be read to limit the use of the garland for other uses including but not limited to craft applications, home decorating, packaging and other applications.

Synthetic fur in the form of knitted plush pile fabric has long been constructed in a circular knit forming a tubular shape. Raw stock, natural and synthetic fibers are interlocked into the tubular knitted body mesh, commonly known as "backing" in the trade. A backing coating is applied to stabilize the fabric and hold its shape. The tubular fabric is then slit lengthwise to produce piece goods. The piece goods are sewn together to make a continuous sheet to which the back coating is supplied generally described as sizing or a latex bonding agent for stability of the fabric. The face is then finished using vacuum, heat setting, shrinking and shearing to make the surface uniform or to groom in various contours. Even with the sizing on the backing, the knitted structure of the body mesh allows it to be pulled and stretched crosswise with little or no stretch lengthwise. The construction and characteristics of plush pile knitted fabrics is described in a number of U. S. Patents including U.S. Pat. No. 3,010,297 to Hill, U.S. Pat. No. 3,299,672 to Schmidt, U.S. Pat. No. 1,894,596 to Moore, U.S. Pat No. 2,953,002 to Hill, and U.S. Pat. No. 3,413,823, and U.S. Pat. No. 3,590,604 to Beucus, all incorporated herein by reference.

A few years ago, garland made of knitted plush pile fabric was offered for sale for Christmas trees but it was abandoned since there was no solution to the problem of the limited lengths available due to the width of the fabric. With lengths of about six feet, the effect of continuous draping garland of the Christmas tree was lost and the product was abandoned.

SUMMARY OF THE INVENTION

The method of making synthetic fur garland includes providing a plush pile knitted fabric comprising a knitted body mesh with a face of plush pile fibers interlocked into the body mesh wherein the knit allows the fabric to be pulled crosswise and not lengthwise. A strip of fabric is cut crosswise across the width of the fabric after which the fabric strip is pulled along the length causing the strip to curl into a tubular shape with the fur on the outside. Attachment devices are fixed to each end of the curled strip for attaching, detaching, and reattaching the ends to other lengths of garland forming continuous garland of any chosen length. The preferred method of fixing the attachment means includes attaching a first attachment device to one end of the curled strip with the body mesh wrapped around at least a portion of the attachment means and adhesively attaching a second attachment device at the other end of the curled strip with the body mesh wrapped around at least a portion of the second attachment device wherein the attachment devices attach, detach, and reattach with each other forming an interconnection of garland lengths.

The invention further includes a synthetic fur garland comprising a tubular shape of synthetic plush pile with the face of the plush pile fibers extending outwardly with a seam along the length of the fur garland, wherein the improvement comprises and attachment devices on each end of the garland length for attaching, detaching, and reattaching the ends of the garland to other lengths of garland to form a continuous length of garland.

It is an object of this invention to provide a synthetic fur garland in lengths that may be easily packaged and handled but that are capable of attachment, detachment, and reattachment to form any chosen length of garland so as to provide a continuous drape of the distance required for the chosen effect.

It is an additional object of the present invention to provide a method of adhesively closing a tubular imitation fur garland shape so that the seam lengthwise along the garland does not open and is aesthetically pleasing.

It is a further object of the present invention to provide synthetic fur garland in easily handleable lengths with the lengths attachable, detachable, and reattachable at their ends to form any chosen lengths of continuous garland wherein the attachment devices at the ends are essentially totally hidden.

It is an additional object of the present invention to provide synthetic fur garland in the form of a cylindrical tube wherein the seam along the lengths of the garland is adhesively attached without significantly affecting the drapability and handling of the garland.

It is a particular object of the present invention to provide an adhesively connected seam which is soft and pliable and yet hold together without interfering with the drapability of the garland.

It is an additional object of the present invention to provide an attachment device at each end of synthetic fur garland lengths which will allow attachment of those lengths to form garland of any chosen length where the attachment device does not interfere with the drapability and appearance of the fur garland.

It is an additional object of the present invention to provide fur garland of varying contours wherein the diameter of the fur garland varies substantially along the length including the formation of the continuous by attached fur balls.

It is an additional object of the present invention to provide synthetic fur garland with varying color along the length of the garland including the shape of varying colored balls, varying color strips, and varying random color patterns.

When the fur garland was originally produced, the use of hot melt adhesive to attach the garland lengths together to form a continuous length was considered. In addition, hot melt adhesive was used to close the lengthwise seam of the garland lengths. The use of the hot melt adhesive formed rigid sections and parts of the garland lengths which adversely affected the drapability and appearance of the garland In addition, construction of a continuous length of garland made it difficult to market to the consumer and difficult for the consumer to handle. The above invention satisfies the needs and the objections to the original commercial offering.

DESCRIPTION OF THE PREFERRED EMBODIMENTS

Figure 1:
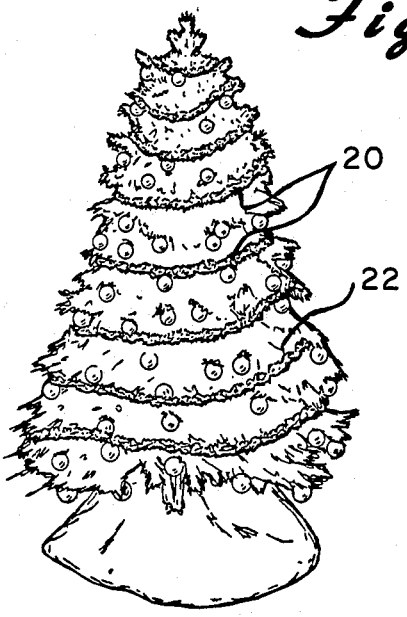
FIG. 1 is a perspective view of a Christmas tree festooned with garland of the present invention.
Figure 2:
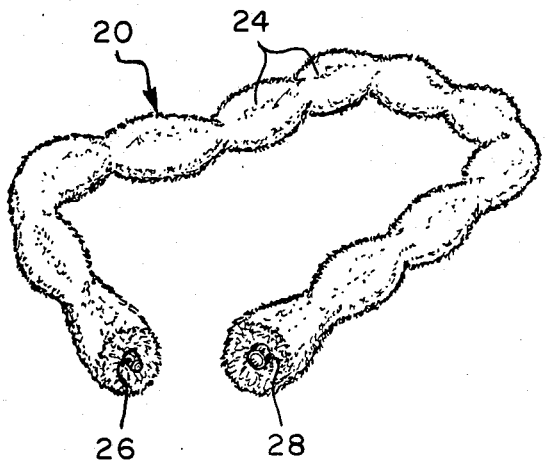
FIG. 2 is a perspective view of the fur garland of the present invention.

The garland of the present invention will most commonly be draped in residental homes at the holidays and most specifically is draped on Christmas trees as illustrated in FIG. 1. Garland 20 is draped in a continuous length from top to bottom on tree 22. It is important that the garland be continuous as it is most effective to wrap the garland round and round the tree while breaks and interruptions would provide an unsatisfactory effect. A close-up of garland 20 is illustrated in FIG. 2 and it should be noted that the illustrations in this figure and in the balance of the figures are not necessarily to scale in order to best represent the characteristics of the garland the the method of preparation. For example, in FIG. 2, the length of garland 20 if you assume that the scale is about one-third would appear to be about two feet in length if it were drawn to exact scale. Actually it is preferred that the length of the garland be five or six feet in length with the ability to interconnect the lengths to form any desired continuous length. Garland 20 is formed having the appearance of attached puff balls 24. This is a preferred shape but the garland may be constructed so that there is a continuous and more even appearance with no undilating ball shapes. The color of the fabric from which the garland is formed may be patterned in color. For example, stripes of varying colors may be angled to the length of the fabric so that when the garland is formed, a "candy-stripe" effect will be achieved Random color may be applied to the fabric so that there is a random color pattern in the garland. The ungrooved shape where the pile length is constant also provides a most effective appearance. Further, ball shapes 24 may be in alternate colors or in multi-colored hues repeating in a regular pattern or in a random basis. As will be observed in FIG. 2, there is essentially no visible seam line and the seam may be adhesively attached or may be merely allowed to naturally close. As will be described, the tubular shape of the garland will tend to hold its shape and may be restored to the tubular shape by pulling the garland lengthwise. End attachment 26 will forcibly interfit into end attachment 28 to connect garland 20 in a loop or more usefully to other lengths of garland to form a continuous length.

Figure 3:
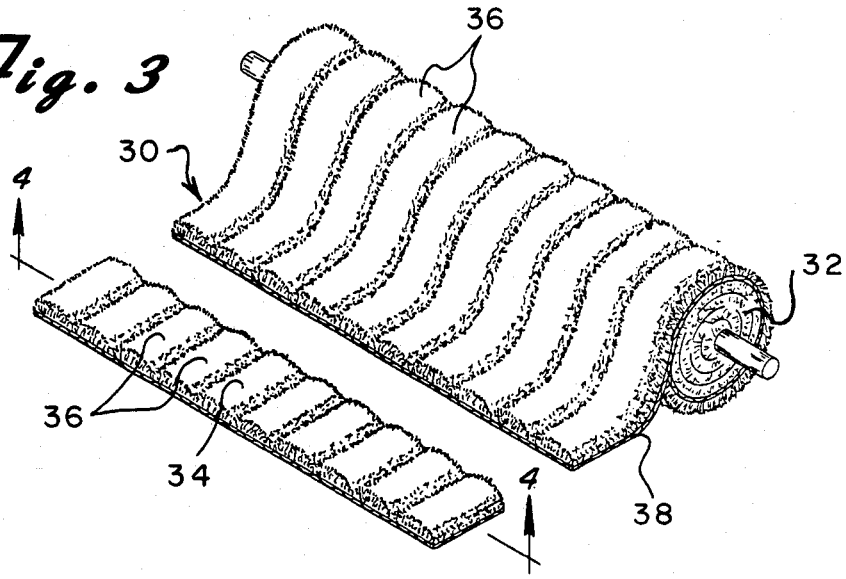
FIG. 3 is a roll of knitted pile fabric with a cross-wise strip cut from the roll.
Figure 4:
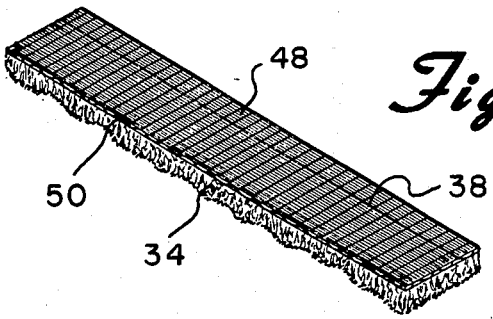
FIG. 4 is an under side perspective view of the strip viewed along lines 4—4 of FIG. 3.
Figure 5:
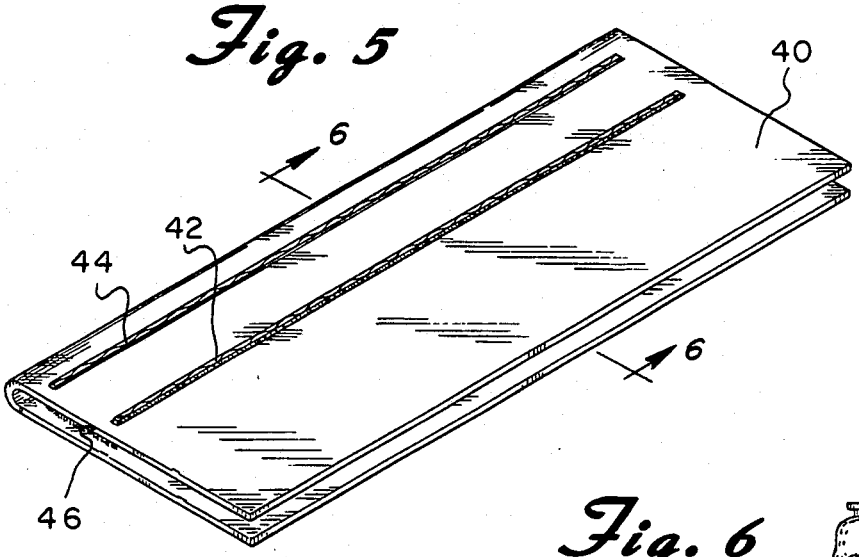
FIG. 5 is a perspective view of a template for applying contact adhesive to the lengthwise edges of the strip of FIG. 4.
Figure 6:
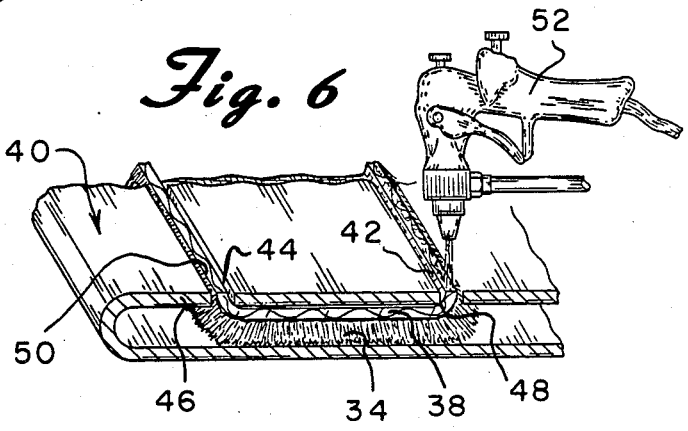
FIG. 6 is a cross-sectional view of the template and the strip taken along lines 6—6 with a glue spray applicator device.
Figure 7:
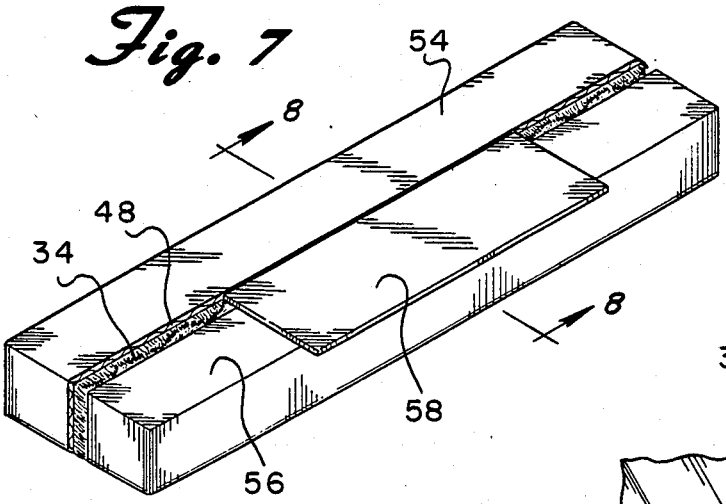
FIG. 7 is a perspective view illustrating a holder for the strip of FIG. 4 with a shield device.
Figure 8:
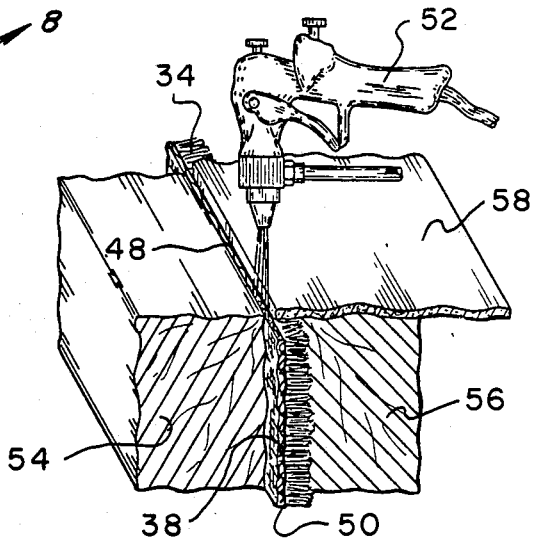
FIG. 8 is a cross-sectional view of the holder and shield of FIG. 7 with a contact adhesive dispensing device.

In FIG. 3, knitted pile fabric 30 is loosely wound on a core to form roll 32. Again the relative scale of the characteristics of this fabric is adjusted to more easily display the characteristics. The width of fabric 30 is about 58–60 inches and the width of strip 34 is about an inch to an inch and one-half. Further, the raised lengthwise ridges 36 and intervening grooves are about an inch and one-half to an inch and three-quarters from valley to valley. This ridged contruction is known as "pelting" in the trade. Ridges 36 are formed by either shearing the pile to varying lengths or by attaching varying pile lengths to the knitted body mesh 38 or both. The pile length may be varied from an extremely long plush to a closely cropped plush which will achieve different results. It is preferred that the length of the pile be about one-half to one and one-half inches in length at the maximum pile height and is most preferred to be in a range of about three-quarters of an inch in length. In FIG. 4, strip 34 has been turned over so that the plush fur is forcing downwardly. In this position, strip 34 is placed in template 40 with body mesh or backing 38 facing upwardly. Template 40 is supplied with slots 42 and 44 spaced apart a distance approximating the width of strip 34 and of lengths at least as long as strip 34. When strip 34 is placed under top frame 46 of template 40 lengthwise edges 48 and 50 of the backing and the pile of strip 34 are exposed and actually tend to extend upwardly out of slots 42 and 44. As illustrated in FIG. 6, strip 34 is held in position with top frame 46 with the edges 48 and 50 exposed through slots 42 and 44 which can be easily coated with contact adhesive using spray device 52. As spray device 52 applies the contact adhesive, top frame 46 is pressed downwardly to expose the pile located along edges 48 and 50 so that the contacted adhesive reaches the pile fibers. When edges 48 and 50 are brought together, the contact adhesive on the pile edges touches and adhere to form an essentially invisible seam. The ends of the pile are left uncontacted by the adhesive and essentially hide the seam. An alternative method of gluing is illustrated in FIG. 7 wherein strip 34 is held between blocks 54 and 56 exposing the lengthwise edges between the blocks not only the pile of strip 34 but body mesh edge 48 on the top and body mesh edge 50 on the bottom. In order to prevent excess adhesive from gumming up the pile, flat shield plate 58 is positioned to protect the ends of the pile from contact adhesive over spray. Effective adhesives include but are not limited to contact adhesives and pressure sensitive adhesives, supplied the 3 M Company, Bostic, Tacc, National Stardi, Fuller Company, Firestone, Goodyear, Hysol, SWK and other companies. Adhesives may be supplied in colorless form or in colors to match the color of the pile. As illustrated in FIG. 8, shield plate 58 is positioned to protect the pile ends of the and moved as contact adhesive sprayer 52 is moved firstly to apply adhesive to edge 48 and later to edge 50. Again, contact adhesive is applied to the pile close to the edges which when brought together adhere to form the seam. Adhesive may be applied by wheels, rollers or other applicators and need not be contact adhesive. A relatively slow drying adhesive may be applied to one or both of the pile edges. When the strip is pulled end to end to bring the edges together, the natural tenancy of the fabric to hold that tubular shape maintains the position of contact allowing the adhesive to dry and form an effective seam.

Figure 9:
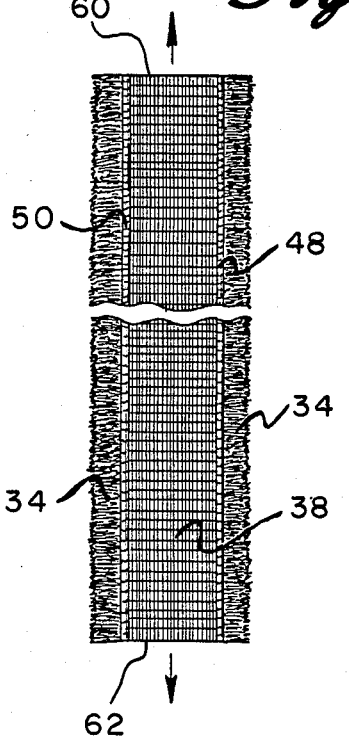
FIG. 9 is a bottom plan view of the strip of FIG. 4 illustrating force being applied end to end to curl the strip in the form of a garland.
Figure 10:
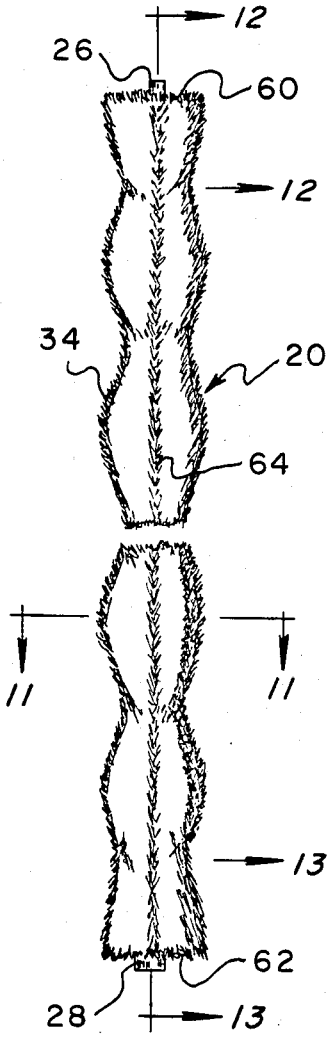
FIG. 10 is an expanded plan view of the garland of FIG. 2 illustrating each end.
Figure 11:
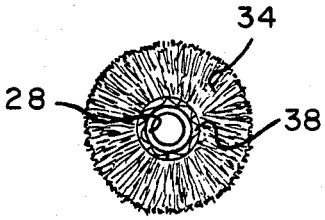
FIG. 11 is a horizontal cross-sectional view taken along lines 11—11 of FIG. 10.
Figure 12:
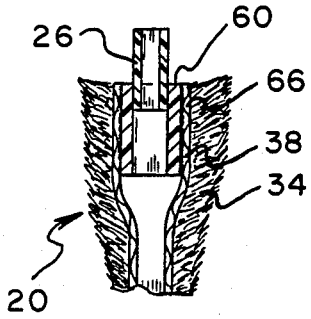
FIG. 12 is a vertical cross-sectional view taken along lines 12—12 of FIG. 10.
Figure 13:
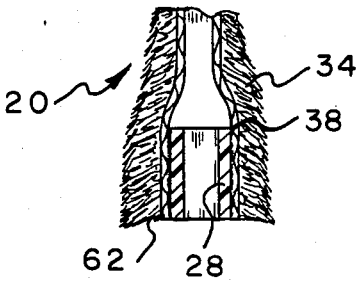
FIG. 13 is a vertical cross-sectional view taken along lines 13—13 of FIG. 10.

In FIG. 9, strip 34 is now pulled end to end such that ends 60 and 62 are each pulled curling the fabric strip into a tubular shape such that edges 48 and 50 meet and abut each other. If adhesive has been applied according to the directions above as illustrated in FIGS. 5 through 8, the edges are immediately adhesively attached by the contact adhesive. If no adhesive has been applied, ends 48 and 50 still tend to abut each other and the seam, because of the length of the plush is hidden. In FIG. 10, garland 20 has been formed of the tubular shape of strip 34. Seam 64 of abutted edges 48 and 50 is essentially invisible. In the cross-sectional view of FIG. 11, body mesh 38 has formed a circular shape with the seam either abutting or adhesively attached with the pile of strip 34 extending radially outwardly forming a beautiful garland. In FIG. 12, end attachment 26 is a small flexible polymeric tube adhesively attached to the inside surface of larger flexible polymeric plastic tube 66 which is in turn is adhesively attached to the inside surface of body mesh 38 allowing a portion of tube end attachment 26 to extend past end 60. Actually, the degree of extension of tube 26 past the end is exaggerated in this view for illustration purposes only and the outside end of tube 26 may be proximate to end 60 since the fabric is flexible and will be pushed aside to allow attachment. In FIG. 13, end attachment 28 is a larger flexible polymeric plastic tube roughly the same size and shape as tube 66. Tube 28 is adhesively attached to the inside surface of body mesh 38 at end 62. The size, flexibility and ductility of tubes 26 and 28 are chosen so that tube 26 may be forcibly inserted into the inside diameter of tube 28 providing a snug and firm fit which will hold the ends of the garland together but be able to be detachably removed to adjust the length or for storing the garland. In FIGS. 12 and 13, the difference in the diameter of the body mesh 38 around the end attachments showing that it necks down after the end attachment toward the length of the garland is exaggerated and the end attachments may be chosen to approximate the natural size and shape of curled strip 34 so that the end attachments provide no noticeable bulge.

Alternative end attachments include using VELCRO attachments, a commercially available material wherein hooks on one side of the fabric interlock with the base fabric. Tubular or rod type members are adhesively attached to the ends of the garland in the same fashions as tubes 28 and 66 are attached above. These members need not extend past the ends of the garland and may be slightly hidden inside the tubular shape of the garland. Small VELCRO pieces approximately the size of the ends of the members with opposite type of VELCRO attachments are adhered on opposite ends of each garland length. Additional satisfactory attachment devices include injection molded male and female snap fits wherein the shape of the interconnect is like the attachment molded in polyethylene polymer for popit beads. Other forms of attachment include snaps and hooks although some of these attachments are more visible and less desirable. A most effective appearance is obtained by applying "glitter" to the garland after it has been constructed. Glitter is generally supplied in a organic liquid carrier with a small quantity of adhesive into which small metallic appearing reflective particles are dispersed The liquid dispersion of the particulate is sprayed on the garland distributing glitter along the length. This is particularly effective on lighted Christmas trees.

It is preferred that the fabric by supplied with varying heights of pile preferably forming parellel rounded ridges and grooves running lengthwise of the fabric, generally described as "pelting", the ridges and grooves likewise running crosswise to the length of the cut strips. When the strips are pulled end to end, the garland is formed in the shape of a continuous length of attached fur balls. Varying fabric sheets can be obtained with the pile length an inch and one half long or longer where "puff-ball" effects are achieved. The parallel ridges may be of varying colors with alternate colors or any chosen pattern of colors such that when the cut strips are pulled, there is a tube of attached fur balls of varying color. After the strip of fabric is cut crosswise across the width of fabric, it is preferred to apply an adhesive to the lengthwise edges of the plush pile of the fabric strip. It is preferred that this adhesive be contact adhesive such that when the lengthwise edges of the plush pile come into contact upon pulling the fabric strip along its length, there is an immediate adhesive bond. In the alternative, the method includes allowing the adhesive to dry after the strip of fabric has been pulled end to end to bring the adhesive into contact with the adjacent edges of the pile. It is particularly preferred that the adhesive be a spray contact adhesive. The preferred attachment device includes adhesively attaching a short length of polymeric plastic tubing at one end of the curled strip and the body mesh wrapped around at least a portion of the length of the tubing. It is more preferred that the body mesh be wrapped around the entire length of tubing so that the tubing is hidden. The preferred attachment method further includes attaching a second short length of flexible short length of polymeric plastic tubing at the other end of the curl strip with the body mesh wrapped around at least a portion of the second length of the tubing. It is preferred that a portion of the tubing extend past the end of the curled strip. The attachment device further includes that the second short length of tubing forcibly interfits inside the first length of tubing allowing the detachable and reattachable interconnection of garland lengths. It is preferred that the synthetic fur garland further comprise a short length of flexible polymeric plastic tubing adhesively attached in one end of the curled garland strip with the strip wrapped around at least a portion of the length of that tubing and a second short length of flexible polymeric plastic tubing adhesively attached at the other end of the curled strip with the curled strip wrapped around at least a portion of the second length of tubing, wherein the second short length of tubing forcefully interfits inside the first length of tubing allowing the detachable and reattachable interconnection of garland lengths. It is preferred that the synthetic fur garland have the length of the plush pile fibers vary to form a series of connected fur ball shapes along the length of the garland While this invention has been described with reference to the specific embodiments disclosed herein, it is not confined to the details set forth and the patent is intended to include modifications and changes which may come within and extend from the following claims.

I claim:

1. A method of making an synthetic fur garland comprising:

(a) providing a synthetic plush pile knitted fabric comprising a knitted body mesh with a face of plush pile fibers interlocked into the body mesh wherein the knit allows the fabric to be pulled crosswise and not lengthwise, (b) cutting a strip of fabric crosswise across the width of the fabric, (c) pulling the fabric strip along its length causing the strip to curl into a tubular shape with the fur on the outside, and (d) fixing attachment means to each end of the curled strip for attaching, detaching, and reattaching the ends to other lengths of garland forming a continuous length of garland.

2. A method of making an synthetic fur garland comprising:

(a) providing a synthetic plush pile knitted fabric comprising a knitted body mesh with a face of plush pile fibers interlocked into the body mesh wherein the knit allows the fabric to be pulled crosswise and not lengthwise, (b) cutting a strip of fabric crosswise across the width of the fabric, (c) pulling the fabric strip along its length causing the strip to curl into a tubular shape with the fur on the outside, (d) adhesively attaching a first attachment means to one end of the curled strip with the body mesh wrapped around at least a portion of the attachment means, and (e) adhesively attaching a second attachment means at the other end of the curled strip with the body mesh wrapped around at least a portion of the second attachment means, wherein the attachment means attach, detach, and reattach with each other forming an interconnection of the garland lengths.

3. The method of claim 2 wherein the fabric is supplied having varying heights of pile forming parallel rounded ridges and grooves running lengthwise of the fabric and likewise running crosswise to the cut strips wherein pulling the strips end to end forms a continuous length of attached fur ball shaped garland.

4. The method of claim 3 wherein the fabric is supplied having adjacent parallel ridges of varying colors running lengthwise of the fabric wherein pulling the cut strips forms a continuous length of attached fur balls of varying colors.

5. The method of claim 2 wherein the fabric is supplied with adjacent stripes of varying color running diagonally to the length of the fabric.

6. The method of claim 2 wherein after the cutting of the strip of fabric the method includes applying an adhesive to the lengthwise edges of the plush pile of the fabric strip.

7. The method of claim 6 wherein the adhesive is a contact adhesive.

8. The method of claim 7 wherein the contact adhesive is sprayed on the lengthwise edges of the plush pile.

9. The method of claim 6 wherein after pulling the fabric strip, the adhesive on the lengthwise edges on the plush pile comes into contact with pile on the abutting edge and is allowed to dry.

10. The method of claim 2 wherein after the attachment means are fixed to the ends of the curled strip, the method includes spraying a liquid carrier containing glitter particles onto the fur garland.

11. The method of claim 2 wherein it further comprises adhesively attaching a short length of flexible polymeric plastic tubing at one end of the curled strip while wrapping the body mesh around at least a portion of the length of tubing and the further comprising adhesively attaching a second short length of flexible polymeric plastic tubing at the other end of the curled strip while wrapping the body mesh around at least a portion of the second length of tubing, and wherein the second length of tubing is of the size to forcefully interfit inside the first length of tubing allowing the detachable and reattachable interconnection of garland lengths.

12. The method of claim 2 wherein the method further comprises wrapping and adhesively attaching a body member in one end of the curled strip, adhesively attaching a piece of VELCRO fastening fabric to the exposed end of the body member, wrapping and adhesively attaching a second body member in the other end of the curled strip, and adhesively attaching a second VELCRO piece adhesively attached to the exposed end of the second body member, wherein the VELCRO pieces are chosen to connect with each other and additional lengths of garland.

13. A method of making an synthetic fur garland comprising:

(a) providing an synthetic plush pile knitted fabric comprising a knitted body mesh with a face of plush pile fibers interlocked into the body mesh in a continuous length of fabric wherein the knit allows the fabric to be pulled crosswise and not lengthwise, (b) cutting a strip of fabric crosswise across the width of the fabric, (c) applying an adhesive to the lengthwise edges of the plush pile of the fabric strip, (d) pulling the fabric strip along its length causing the strip to curl into a tubular shape with the fur on the outside of the lengthwise edges abutting and becoming adhesively attached, and (e) fixing attachment means to each end of the curled strip for attaching, detaching, and reattaching the ends to other lengths of garland for forming a continuous length of garland 14. The method of claim 13 wherein the adhesive is a contact adhesive.

15. The method of claim 14 wherein the contact adhesive is sprayed on the lengthwise edges of the plush pile.

16. A method of making an synthetic fur garland comprising:

(a) providing a synthetic plush pile knitted fabric comprising a knitted body mesh with a face of plush pile fibers interlocked into the body mesh in a continuous length of fabric wherein the knit allows the fabric to be pulled crosswise and not lengthwise, (b) cutting a strip of fabric crosswise across the width of the fabric, (c) pulling the fabric strip along its length causing the strip to curl into a tubular shape with the fur on the outside, (d) adhesively attaching a short length of flexible polymeric plastic tubing at one end of the curled strip with the body mesh wrapped around at least a portion of the length of tubing, and (e) adhesively attaching a second short length of flexible polymeric plastic tubing at the other end of the curled strip with the body mesh wrapped around at least a portion of the second length of the tubing, wherein the second short length of tubing forcefully interfits inside the first length of tubing allowing the detachable and reattachable interconnection of garland lengths.

17. The method of claim 16 wherein after the cutting of the strip of fabric the method includes applying an adhesive to the lengthwise edges of the plush pile of the fabric strip.

18. The method of claim 17 wherein the adhesive is a contact adhesive.

19. The method of claim 17 wherein the fabric is supplied having varying heights of pile forming parallel rounded ridges and grooves running lengthwise of the fabric and likewise running crosswise to the cut strips, wherein pulling the strips end to end forms a continuous length of attached fur ball shaped garland.

20. The method of claim 19 wherein contact adhesive is sprayed on the lengthwise edges of the plush pile.

21. A synthetic fur garland comprising a tubular shape of synthetic plush pile with the face of the plush pile fibers extending outwardly with a seam along the length of the fur garland, wherein the improvement comprises attachment means on each end of the garland length for attaching, detaching, and reattaching the ends of the garland to other lengths of garland to form a continuous length of garland.

22. The synthetic fur garland of claim 21 further comprising a short length of flexible polymeric plastic tubing adhesively attached in one end of the garland strip with the strip wrapped around at least a portion of the length of that tubing and a second short length of flexible polymeric plastic tubing adhesively attached at the other end of the strip with the strip wrapped around at least a portion of the second length of tubing, wherein the second short length of tubing forcefully interfits inside the first length of tubing allowing the detachable and reattachable interconnection of garland lengths.

23. The synthetic fur garland of claim 21, wherein the length of the plush pile fibers vary to form a series of connected ball shapes along the length of the garland.

* * * * *